US006628905B2

(12) United States Patent
Hori et al.

(10) Patent No.: US 6,628,905 B2
(45) Date of Patent: Sep. 30, 2003

(54) IMAGE FORMING APPARATUS

(75) Inventors: Kenjiro Hori, Saitama (JP); Koichi Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/878,209

(22) Filed: Jun. 12, 2001

(65) Prior Publication Data

US 2002/0021910 A1 Feb. 21, 2002

(30) Foreign Application Priority Data

Jun. 13, 2000 (JP) ..... 2000-177397

(51) Int. Cl.[7] ..... G03G 15/00; G03G 15/16
(52) U.S. Cl. ..... 399/38; 399/66; 399/101
(58) Field of Search ..... 399/38, 50, 53, 399/66, 101, 149

(56) References Cited

U.S. PATENT DOCUMENTS 4,367,948 A 1/1983 Suzuki
4,482,243 A 11/1984 Suzuki et al.
4,853,740 A 8/1989 Ushio et al.
5,676,363 A 10/1997 Kishida et al. ..... 271/9.06
6,064,837 A * 5/2000 Hashimoto et al. ..... 399/50
6,246,847 B1 * 6/2001 Jeong et al. ..... 399/101

* cited by examiner

*Primary Examiner*—Hoang Ngo
(74) *Attorney, Agent, or Firm*—Fitzpatrick, Cella, Harper & Scinto

(57) ABSTRACT

An object of the present invention is to provide an image forming apparatus that has an image bearing member voltage applying device for applying a voltage having a polarity reverse to that of the toner to the conductive portion of the image bearing member, a charging voltage applying device for applying a voltage to the charging device, a developing voltage applying device for applying a voltage to the developing device, and a transfer voltage applying device for applying only a voltage having a polarity reverse to that of the toner to the transfer device, wherein, the apparatus has a cleaning mode in which, when an image forming is not effected, the voltage is applied to the image bearing member by the image bearing member voltage applying device and the voltage applied to the transfer device from the transfer voltage applying device is turned off or made lower than the voltage applied at the image forming time.

8 Claims, 14 Drawing Sheets

IMAGE FORMING APPARATUS

BACKGROUND OF THE INVENTION

1. Field of the Invention

The present invention relates to an image forming apparatus such as a copying machine, a printer, a facsimile machine and the like performing an image formation by an electrophotographic system or an electrostatic recording system.

2. Related Background Art

FIG. 19 is a schematic block diagram showing one example of an image forming apparatus utilizing the conventional electrophotographic system.

This image forming apparatus comprises an electrphotographic photosensitive member (hereinafter referred to as a photosensitive drum) of a drum type as an image bearing member, around the periphery of which are disposed a charging roller 2, an exposing apparatus 3, a developing apparatus 4, a transfer roller 5 and a cleaning blade 6.

The photosensitive drum 1 is constituted in such a manner that an OPC photosensitive member layer 1*b* is formed on the outer surface of a conductive drum base 1*a* comprising, for example, aluminum and the like, and is rotationally driven by a drive apparatus (not shown) in the arrow direction (clockwise) at a predetermined process speed (a circumferential speed). The drum base 1*a* of the photosensitive drum 1 is grounded to a ground (GND).

The charging roller 2 as contact charging means is formed in a roller shape with a resistantly adjusted elastic layer 2*b* disposed on a metal core 2*a* and is rotated in the arrow direction (anticlockwise direction). The charging roller 2 contacts the surface of the photosensitive drum 1 by a predetermined pressing force, and by a charging bias (a bias in which an alternating voltage is superposed on a direct-current voltage) applied from a charging power source 170, the photosensitive drum 1 is charged with a predetermined potential of a negative polarity in the present conventional example.

Regarding the exposing apparatus 3, a modulated laser light according to the time series digital image signal of the image information to be inputted is outputted from a laser output portion (not shown) and performs an image-exposure-L on the surface of the photosensitive drum 1 so that an electrostatic latent image is formed on the surface of the photosensitive drum 1 charged by the charging roller 2 according to the image information.

The developing apparatus 4 allows a developer (for example, a magnetic one component insulating toner t in the present conventional example) borne on a developing sleeve 4*a* to be adhered on the electrostatic latent image formed on the photosensitive drum 1, and visualizes the latent image as a toner image by a reversal-developing. The non-magnetic developing sleeve 4*a* which is rotated at a speed approximately equal to that of the photosensitive drum 1 is arranged with a minute gap portion (for example, below 200 $\mu$m) disposed against the photosensitive drum 1 and magnetically confines the toner t on the surface of the developing sleeve 4*a* by a magnetic force of a magnetic roll 4*b* fixed and involved in the interior of the developing sleeve 4*a*. The toner t magnetically confined on the developing sleeve 4*a* is regulated to a predetermined layer thickness by a layer thickness regulating blade 4*c*.

The developing sleeve 4*a* is applied with a developing bias in which the alternating voltage in a square wave shape is superposed on the direct-current voltage from a developing power source 180. In this way, an electrical field is generated in the gap portion between the developing sleeve 4*a* and the photosensitive drum 1, and a toner t on the surface of the developing sleeve 4*a* flies. On this occasion, the portion not subjected to the image-exposure-L in the surface (OPC photosensitive member layer 1*b*) of the photosensitive drum 1 is charged with a negative polarity. The surface potential thereof is reduced lower than the direct-current voltage of the negative polarity of a developing power source 180 and exerts a force on the toner t in a direction to push it back to the developing sleeve 4*a*. Accordingly, by the alternating electrical field of the gap portion generated by the alternating voltage of the developing power source 180, even when the toner t flies, it is pushed back to the interior of the developing apparatus 4.

On the other hand, since the portion subjected to the image-exposure-L in the surface (OPC photosensitive member layer 1*b*) of the photosensitive drum 1 is attenuated in a negative charge, that portion becomes higher than the direct-current voltage of the negative polarity of the developing power source 180 (the absolute value of the negative voltage of that surface portion is reduced lower than the absolute value of the direct-current voltage of the developing power source 180), and exerts a force on the toner t to pull it back to the photosensitive drum 1. Accordingly, by the alternating electrical field of the gap portion generated by the alternating voltage of the developing power source 180, the toner t flies and the flied toner t is adhered on the surface of the photosensitive drum 1.

In this way, the portion subjected to the image-exposure-L in the surface of the photosensitive drum 1 is adhered with the toner t and the portion not subjected to the image-exposure-L in the surface of the photosensitive drum 1 is not adhered with the toner t, so that the toner t is adhered on the electrostatic latent image formed by being subjected to the scan-exposure-L, whereby the toner image is formed.

The transfer roller 5 as contact transfer means is formed in a roller shape with a resistantly adjusted elastic member layer 5*b* disposed on a metal core 5*a* and is rotated in the arrow direction (counterclockwise direction).

The transfer roller 5 forms a transfer nip portion by contacting the surface of the photosensitive drum 1 with a predetermined pressing force and transfers the toner image formed on the surface of the photosensitive drum 1 in the transfer nip portion by a transfer bias (a bias of the (positive) polarity reverse to the toner t) applied from a transfer power source 190 to a transfer material P such as a paper and the like.

Next, the image forming operation by the above described image forming apparatus will be described.

When the image forming is effected, the photosensitive drum 1 is rotationally driven by a drive apparatus (not shown) in the arrow direction at a predetermined circumferential speed and is charged with a predetermined potential by the charging roller 2 applied with a negative polarity charging bias from the charging power source 170. With the image-exposure-L according to the image information from the exposing apparatus 3 given to the charged photosensitive drum 1, the potential on photosensitive drum 1 is reduced in the potential of the portion subjected to the image-exposure-L, and the electrostatic latent image is formed according to the inputted image signal.

The toner t, which is charged with the same polarity (negative polarity) as the charged polarity of the photosensitive drum 1 by the developing sleeve 4*a* of the developing apparatus 4 applied with the developing bias of the same polarity of the charged polarity (negative polarity) of the photosensitive drum 1 at a developing position, is adhered on the electrostatic latent image formed on the photosensitive drum 1 and reversal-developed (visualized) as the toner image as described above.

When the toner image on the photosensitive drum 1 reaches the transfer nip portion between the photosensitive drum 1 and the transfer roller 5, in time for this timing, the transfer material P such as the paper and the like in the interior of a cassette (not shown) is conveyed to the transfer nip portion by a sheet feeding roller (not shown), and by the transfer roller 5 applied with a predetermined transfer bias of the polarity (positive polarity) reverse to the above described toner t, the toner image on the photosensitive drum 1 is transferred on the transfer material P conveyed by the transfer nip portion by an electrostatic electrical power generated between the photosensitive drum 1 and the transfer roller 5.

The transfer material P, on which the toner image is transferred, is conveyed to a fixing apparatus (not shown), and the toner image is heated, pressurized and thermally fixed on the transfer material P by a fixing nip between a fixing roller (not shown) and a pressurizing roller (not shown)and, after that, discharged outside and a series of the image forming operation is completed. A transfer residual toner remained on the photosensitive drum 1 after the above described transfer is removed and collected by a cleaning blade 6.

By the way, in the above described image forming, the transfer material P is sometimes stopped from being conveyed in front of the transfer nip portion due to a paper jam (a transfer material jam) and a sheet feeding failure. In this case, the toner image formed on the photosensitive drum 1 adheres on the surface of the transfer roller 5 instead of being transferred on the transfer material P. The toner adhered on the surface of the transfer roller 5 in this way adheres on a rear surface of the transfer material P which is conveyed to the transfer nip portion in the image forming subsequent to the canceling of the above described paper jam and sheet feeding failure, and stains it.

For this reason, in order to avoid such a malfunction, a cleaning operation of the surface of the transfer roller 5 was conventionally performed when an image forming is not effected. This cleaning operation is such that a negative direct-current voltage of the polarity reverse to the transfer time is applied to the metal core 5*a* of the transfer roller 5 from the transfer power source 190, so that an electrical field is generated between the photosensitive drum 1 and the transfer roller 5, thereby the toner adhered on the surface of the transfer roller 5 is transferred to the photosensitive drum 1 side and removed and collected by the cleaning blade 6. Note that, on this occasion, the developing bias is not applied to the developing sleeve 4*a* of the developing apparatus 4.

In order to perform such a cleaning operation, as shown in FIG. 20, the transfer power source 190 is conventionally constituted so as to output positive and negative biases. This transfer power source 190 comprises a positive bias output portion 10 for outputting a positive bias and a negative bias output portion 11 for outputting a negative bias.

The positive bias output portion 10 and the negative bias output portion 11 comprises respectively: pulse generators 12*a,* 12*b* for generating pulses; amplifiers 13*a,* 13*b* for amplifying each pulse outputted from the pulse generators 12*a,* 12*b;* block condensers 14*a,* 14*b* for preventing a direct current component of each output of the amplifiers 13*a,* 13*b;* transformers 15*a,* 15*b* for converting the voltage amplitude of an alternating current component of each output of the amplifiers 13*a,* 13*b* to a predetermined high voltage; diodes 16*a,* 16*b* for rectifying each output of the transformers 15*a,* 15*b;* and each condenser 17*a,* 17*b* and each resistor 18*a,* 18*b*. In this way, the positive bias output portion 10 and the negative bias output portion 11 are identically constituted except that a connecting polarity of each diode 16*a,* 16*b* is reversed.

In this way, in the normal image forming time, the transfer power source 190 allows the pulse generator 12*a* of the positive bias output portion 10 to oscillate and the pulse generator 12*b* of the negative bias output portion 11 to turn off oscillating, and outputs a positive polarity high voltage to the metal core 5*a* of the transfer roller 5 through the resistor 18*a*. On the other hand, in the cleaning of the above described transfer roller 5, the pulse generator 12*b* of the negative bias output portion 11 is allowed to oscillate and the pulse generator 12*a* of the positive bias output portion 10 to turn off oscillating, and a negative polarity high voltage is outputted to the metal core 5*a* of the transfer roller 5 via the resistor 18*b*.

As described above, in order to clean the toner adhered on the transfer roller 5, the conventional image forming apparatus requires the negative bias output portion 11 for applying a voltage of the polarity reverse to the normal transfer time and this caused a problem in that a circuit configuration of the transfer power source 190 becomes complicated.

SUMMARY OF THE INVENTION

An object of the present invention is to provide an image forming apparatus capable of performing a cleaning of transfer means without complicating a circuit constitution of a transfer power source.

Another object of the present invention is to provide an image forming apparatus, comprising:

- an image bearing member having a photosensitive portion on a conductive portion;
- charging means for charging the image bearing member;
- exposing means for exposing the charged image bearing member to form an electrostatic latent image;
- developing means for developing the electrostatic latent image by a toner;
- transfer means for transferring a toner image on the image bearing member to a transfer material;
- image bearing member voltage applying means for applying a voltage having the same polarity as that of toner to the conductive portion of the image bearing member;
- charging voltage applying means for applying a voltage to the charging means;
- developing voltage applying means for applying a voltage to the developing means; and
- transfer voltage applying only means for applying only a voltage having a polarity reverse to that of the toner to the transfer means,
- wherein the apparatus has a cleaning mode in which, when an image forming is not effected, the voltage is applied to the image bearing member by the image bearing member voltage applying means and the voltage applied to the transfer means from the transfer voltage applying means is turned off or made lower than the voltage applied when the image forming is effected.

Still another object of the present invention will be apparent from the following description.

DESCRIPTION OF THE PREFERRED EMBODIMENTS

The embodiments of the present invention will be described below with reference to the drawings.

First Embodiment

Figure 1:
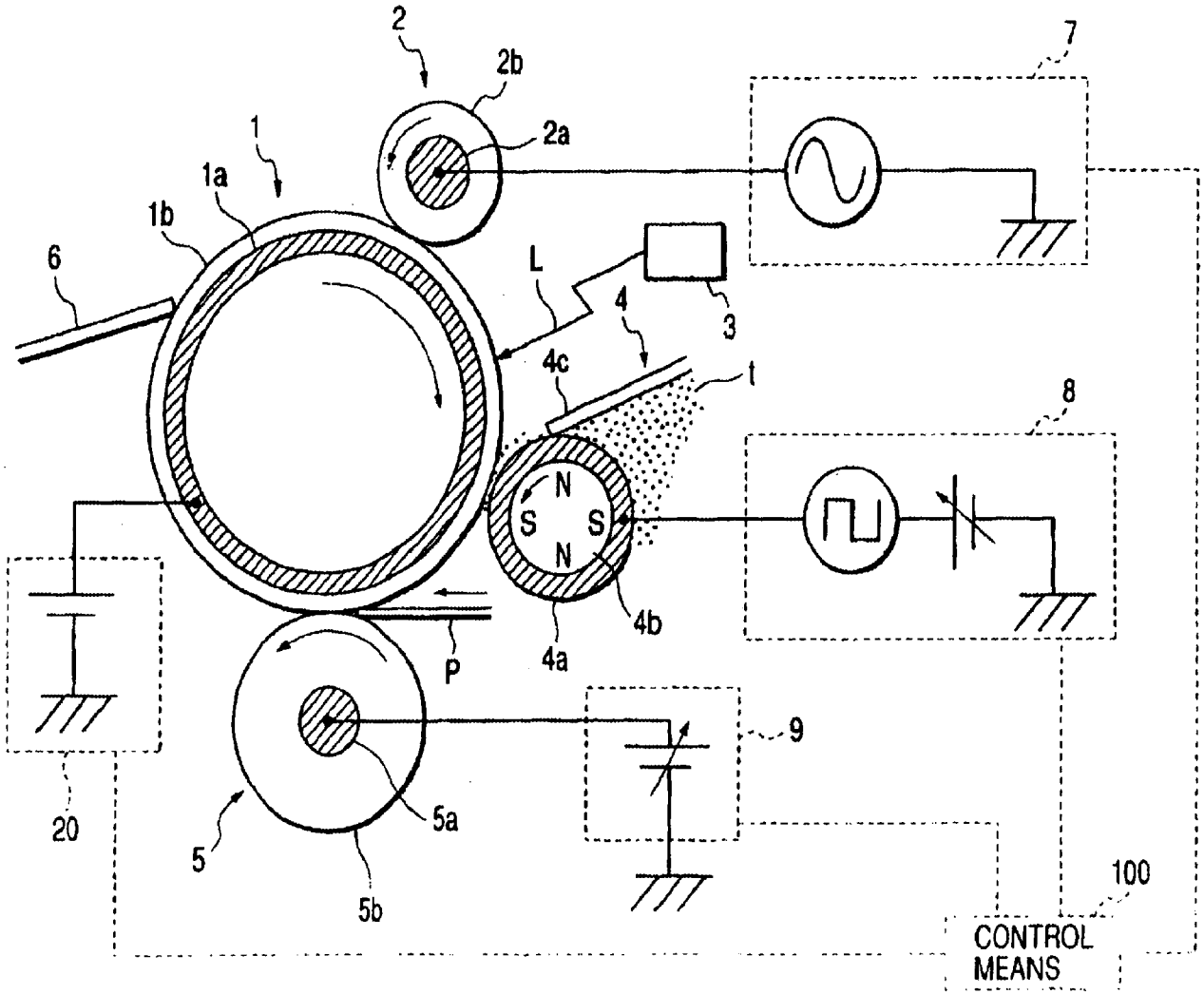
FIG. 1 is a view showing an image forming apparatus which is one embodiment of the present invention.

FIG. 1 is a schematic block diagram showing an image forming apparatus according to a first embodiment of the present invention.

This image forming apparatus comprises a drum type electrophotographic photosensitive member (hereinafter referred to as a photosensitive drum), around the periphery of which a charging roller 2, an exposing apparatus 3, a developing apparatus 4, a transfer roller 5 and a cleaning blade 6 are disposed.

The photosensitive drum 1 is constituted in such a manner that an OPC photosensitive member layer 1*b* which is an exposing portion is formed on the outer surface of conductive drum base 1*a* which is a conductive portion comprising, for example, aluminum and the like, and is rotationally driven by a drive apparatus (not shown) in the arrow direction (clockwise) at a predetermined process speed (a circumferential speed).

The charging roller 2 as contact charging means is formed in a roller shape with a resistantly adjusted elastic member layer 2*b* disposed on a metal core 2*a* and is rotated in the arrow direction (counterclockwise).

The charging roller 2 contacts the surface of the photosensitive drum 1 by a predetermined pressing force, and by a charging bias applied from a charging power source 7 which is charging voltage applying means, the photosensitive drum 1 is charged with a predetermined potential.

Regarding the exposing apparatus 3 which is exposing means, a laser light modulated according to the time series digital image signal of the image information to be inputted is outputted from a laser output portion (not shown) and, by performing an image-exposure-L on the surface of the photosensitive drum 1, an electrostatic latent image according to the image information is formed on the surface of the photosensitive drum 1 charged by the charging roller 2.

The developing apparatus 4 which is developing means allows a developer (for example, a magnetic one component insulating toner t) to be adhered on the electrostatic latent image formed on the photosensitive drum 1, and visualizes it as a toner image by a reversal developing. A non-magnetic developing sleeve 4*a* which is rotated at a speed approximately equal to that of the photosensitive drum 1 is arranged with a minute gap portion (for example, below 200 $\mu$m) disposed against the photosensitive drum 1 and magnetically confines the toner t on the surface of the developing sleeve 4*a* by a magnetic force of a magnetic roll 4*b* fixed and involved in the interior of the developing sleeve 4*a*. The toner t magnetically confined on the developing sleeve 4*a* is regulated to a predetermined layer thickness by a layer thickness regulating blade 4*c*.

A developing bias is applied to the developing sleeve 4*a* from a developing power source 8 which is developing voltage applying means. In this way, an electrical field is generated in the gap portion between the developing sleeve 4*a* and the photosensitive drum 1, and the toner t on the surface of the developing sleeve 4*a* flies. On this occasion, the portion not subjected to the image-exposure-L in the surface (OPC photosensitive member layer 1*b*) of the photosensitive drum 1 is lower in voltage than the voltage of the developing power source 8 and exerts a force on the toner t in a direction to push it back to the developing sleeve 4*a*. Accordingly, due to an alternating electrical field generated in the gap portion by the alternating voltage of the developing power source 8, even when the toner t flies, it is pushed back to the interior of the developing apparatus 4.

On the other hand, since the portion subjected to the image-exposure-L in the surface (OPC photosensitive member layer 1*b*) of the photosensitive drum 1 is attenuated in a charge, that portion becomes higher in voltage than the voltage of the developing power source 8 and exerts a force on the toner t to pull it back to the photosensitive drum 1. Accordingly, by the alternating electrical field of the gap portion generated by the alternating voltage of the developing power source 8, the toner t flies and the flied toner t is adhered on the surface of the photosensitive drum 1.

In this way, the portion subjected to the scan-exposure-L in the surface of the photosensitive drum 1 is adhered with the toner t and the portion not subjected to the image-exposure-L in the surface of the photosensitive drum 1 is not adhered with the toner t, so that the toner t is adhered on the electrostatic latent image formed by being subjected to the scan-exposure-L, whereby the toner image is formed.

The transfer roller 5 as contact transfer means is formed in a roller shape with a resistantly adjusted elastic member layer 5*b* disposed on a metal core 5*a* and is rotated in the arrow direction (counterclockwise).

The transfer roller 5 forms a transfer nip portion by contacting the surface of the photosensitive drum 1 by a predetermined pressing force and transfers the toner image formed on the surface of the photosensitive drum 1 in the transfer nip portion by a transfer bias applied from a transfer power source 9 which is transfer voltage applying means to a transfer material P such as a paper (a recording material). In the image forming apparatus of the present embodiment, a reference power source 20 is electrically connected to a drum base 1*a* of the photosensitive drum 1 (the details thereof will be described later). The circuit configurations of the charging power source 7, the developing power source 8 and the transfer power source 9 in the present embodiment are constituted as described below (the details thereof will be described later).

Figure 2:
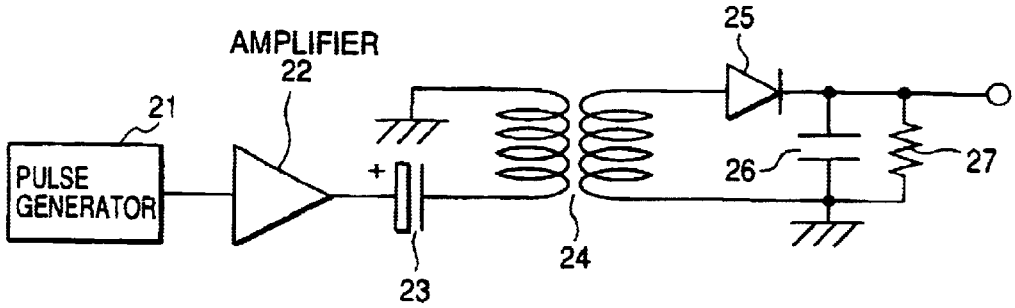
FIG. 2 is a circuit diagram showing a reference power source.

The reference power source 20 comprises, as shown in FIG. 2, a pulse generator 21 for generating a pulse, an amplifier 22 for amplifying the pulse to be outputted from the pulse generator 21, a block condenser 23 for preventing a direct current component of the output of the amplifier 22, a transformer 24 for converting the voltage amplitude of an alternating current component of the output of the amplifier 22 to a predetermined value of high voltage, a diode 25 for rectifying the output of the transformer 22, and a condenser 26, a resistor 27. By the reference power source 20 constituted in this way, the pulse generator 21 is allowed to oscillate, so that the direct-current voltage of a positive polarity can be outputted to the drum base 1*a* of the photosensitive drum 1 through the resistor 27.

Figure 3:
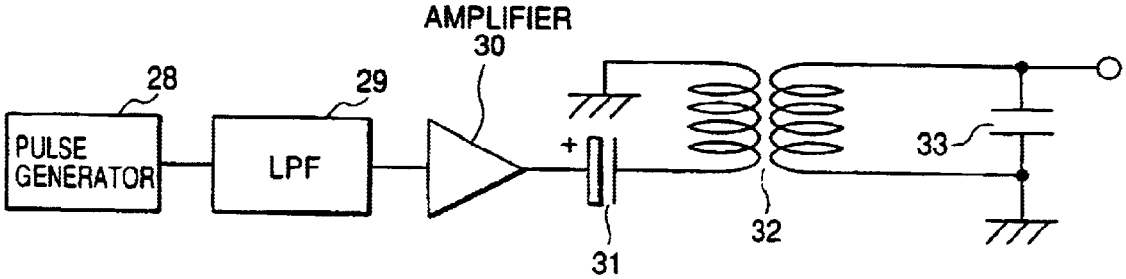
FIG. 3 is a circuit diagram showing a charging power source.

The charging power source 7 of the present embodiment comprises, as shown in FIG. 3, a pulse generator 28 for generating a pulse, a low pass filter (LPF) 29 for shutting off a high frequency component of the pulse outputted from the pulse generator 28 and for bringing a square wave near to a sine wave, an amplifier 30 for amplifying the sine wave outputted from the low pass filter 29, a block condenser 31 for preventing a direct current component of the output of the amplifier 30, a transformer 32 for converting the voltage amplitude of an alternating current component of the output of the amplifier 30 to a predetermined value of high voltage, and a condenser 33. By the charging power source 7 constituted circuit-wise in this way, the pulse generator 28 is allowed to oscillate, so that the alternating voltage of the sine wave can be outputted to the metal core 2*a* of the charging roller 2 through the condenser 33.

Figure 4:
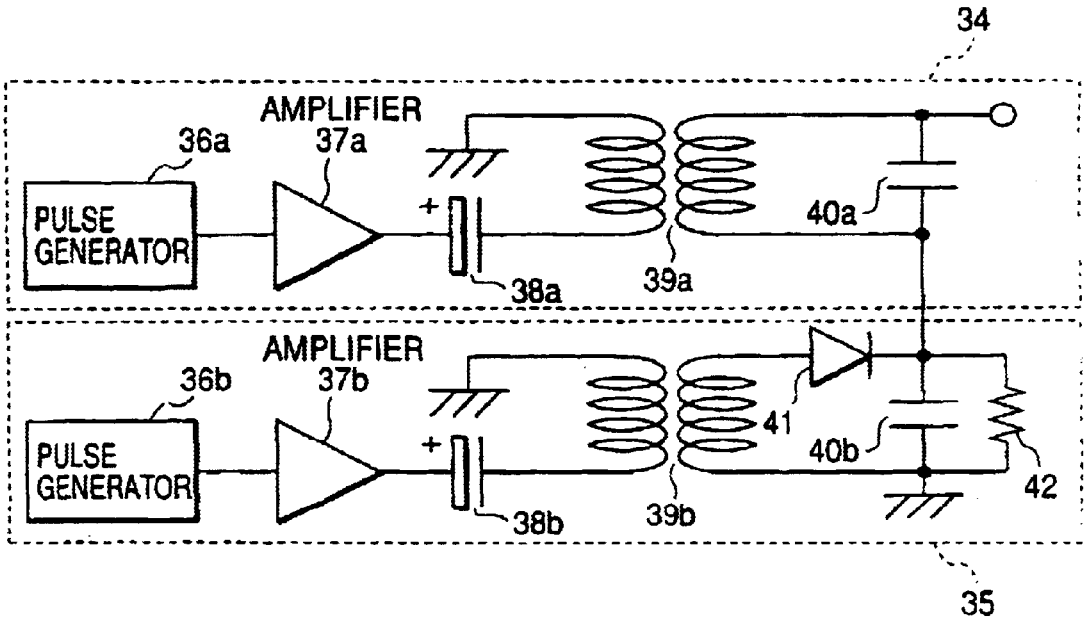
FIG. 4 is a circuit diagram showing a developing power source.

The developing power source 8 of the present embodiment comprises, as shown in FIG. 4, an alternating voltage output portion 34 for outputting the alternating voltage and a direct-current voltage output portion 35 for outputting the direct-current voltage.

The alternating voltage output portion 34 comprises a pulse generator 36*a* for generating a pulse, an amplifier 37*a* for amplifying the pulse outputted from the pulse generator 36*a,* a block condenser 38*a* for preventing a direct current component of the output of the amplifier 37*a,* a transformer 39*a* for converting the voltage amplitude of an alternating current component of the output of the amplifier 37*a* to a predetermined value of high voltage and a condenser 40*a*.

On the other hand, the direct-current voltage output portion 35 comprises a pulse generator 36*b* for generating a pulse, an amplifier 37*b* for amplifying the pulse outputted from the pulse generator 36*b,* a block condenser 38*b* for preventing an direct current component of the output of the amplifier 37*b,* a transformer 39*b* for converting the voltage amplitude of an alternating current component of the output of the amplifier 37*b* to a predetermined value of high voltage, a diode 41 for rectifying the output of the transformer 39*b* and a condenser 40*b,* and a resistor 42.

From the alternating voltage output portion 34 constituted circuit-wise in this way, an alternating voltage is outputted, and from the direct-current voltage output portion 35, a positive polarity direct-current voltage is outputted, so that, from the developing power source 8, an voltage in which the alternating voltage is superposed on the positive polarity direct-current voltage is outputted. In addition, by stopping the oscillating of the pulse generator 36*a* of the alternating voltage output portion 34, the direct-current voltage alone of the direct-current voltage output portion 35 is outputted from the developing power source 8.

Figure 5:
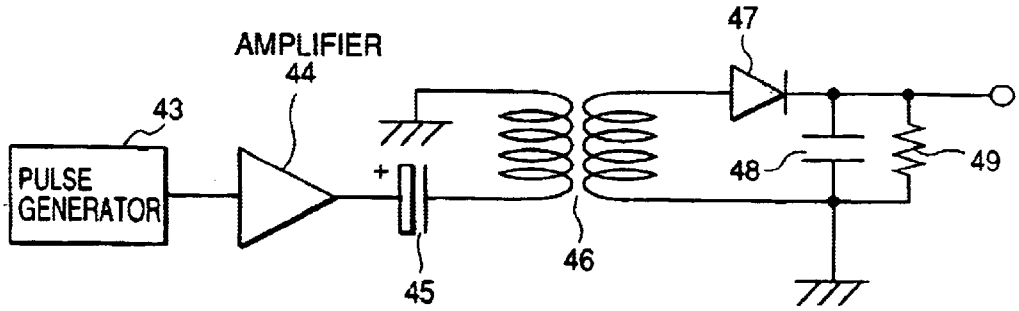
FIG. 5 is a circuit diagram showing a transfer power source.

The transfer power source 9 of the present embodiment comprises, as shown in FIG. 5, a pulse generator 43 for generating a pulse, an amplifier 44 for amplifying the pulse outputted from the pulse generator 43, a block condenser 45 for preventing an direct current component of the output of the amplifier 44, a transformer 46 for converting the voltage amplitude of an alternating current component of the output of the amplifier 44 to a predetermined value of high voltage, a diode 47 for rectifying the output of the transformer 46 and a condenser 48, and a resistor 49.

By the transfer power source 9 constituted in this way, the pulse generator 43 is allowed to oscillate, so that a positive polarity direct-current voltage can be outputted to the metal core 5*a* of the transfer roller 5 through the resistor 49.

Note that the above described charging power source 7, developing power source 8, transfer power source 9, reference power source 20 and the like are controlled by a control apparatus 100, which, at an image forming operation time and a cleaning time of the transfer roller 5 to be described below, control the charging power source 7, the developing power source 8, the transfer power source 9, the reference power source 20 and the like.

Next, the image forming operation by the image forming apparatus of the present embodiment will be described.

At the image formation forming time, the photosensitive drum 1 is rotationally driven by a drive apparatus (not shown) in the arrow direction (clockwise) at a predetermined circumferential speed.

On this occasion, the charging roller 2 is applied with high voltage of the sine wave outputted from the charging power source 7 as shown in FIG. 3

By the charging roller 2 applied with high voltage of this sine wave, the surface of the photosensitive member layer 1*b* of the photosensitive drum 1 is evenly charged with a voltage of the center of the amplitude of the above described sine wave to be applied, that is, a predetermined voltage (about 10 V) V1 which is approximately equal to the ground (GND). To the drum base 1*a* of the photosensitive drum 1, a predetermined direct-current voltage (700 V in the present embodiment) V2 outputted from the reference power source 20 as shown in FIG. 2 is applied.

Accordingly, on both surfaces of the photosensitive member layer 1*b,* a potential difference of (V2−V1) is produced and, on the charged photosensitive drum 1, the image-exposure-L according to the image information from the exposing apparatus 3 is given, so that the potential on the photosensitive drum 1 comes nearer to the potential of the above described reference power source 20 with the potential of the portion subjected to the image-exposure-L reduced lower and the electrostatic latent image according to the image information to be inputted is formed. On this occasion, the surface potential of the photosensitive drum 1 becomes a potential (about 600 V) V3 which is about 100 V lower than the output voltage V2 (700 V) of the reference power source 20.

By the developing voltage to be outputted to the developing sleeve 4*a* of the developing apparatus 4 from the developing power source 8 as shown in FIG. 4, the electrostatic latent image formed on the photosensitive drum 1 is developed. The developing operation of the present embodiment will be described below with reference to FIG. 6.

The surface potential of the portion not subjected to the image-exposure-L by the laser light from the exposing apparatus 3 of the photosensitive drum 1 is a voltage (about 10 V) V1 which is approximately equal to the ground (GND). The toner t in the interior of the developing apparatus 4 is charged with the negative polarity in the present embodiment, and the developing sleeve 4*a* is applied with a positive polarity voltage V4 as a direct current component from the developing power source 8.

Accordingly, at a developing position in which the photosensitive drum 1 opposes to the developing sleeve 4*a,* a force a is exerted on the toner t to pull it to the developing sleeve 4*a* from the photosensitive drum 1 in the portion not subjected to the image-exposure-L of the photosensitive drum 1.

The portion subjected to the image-exposure-L of the photosensitive drum 1 is charged with a potential(about 600 V) V3 which is about 100 V lower than the output voltage V2 (700 V) of the reference power source 20 as described above.

Therefore, in the portion subjected to the image-exposure-L of the surface of the photosensitive drum 1, a force b is exerted on the toner t to pull it to the photosensitive drum 1 from the developing roller 4*a.* That is, the toner t is adhered only on the portion subjected to the image-exposure-L of the surface of the photosensitive drum 1 and the toner t is not adhered on the portion not subjected to the image-exposure-L of the surface of the photosensitive drum 1, so that a desired toner image is developed (visualized) on the surface of the photosensitive drum 1. Note that the developing sleeve 4*a* is also applied with an alternating voltage from the alternating voltage output portion 34 of the developing power source 8. This is a voltage to be applied for allowing the toner t coated on the surface of the developing sleeve 4*a* to fly.

When the toner image on the photosensitive drum 1 reaches the transfer nip portion between the photosensitive drum 1 and the transfer roller 5, in time for this timing, the transfer material P which is the recording material such as the paper in the interior of a cassette (not shown) is conveyed to the transfer nip portion by a sheet feeding roller (not shown), and by the transfer roller 5 applied with a predetermined transfer bias of the polarity (the positive polarity) reverse to the above described toner t, the toner image on the photosensitive drum 1 is transferred on the transfer material P conveyed to the transfer nip portion by an electrostatic force generated between the photosensitive drum 1 and the transfer roller 5.

The transfer material P, on which the toner is transferred, is conveyed to a fixing apparatus (not shown), and the toner image is heated, pressurized and thermally fixed on the transfer material P by a fixing nip between a fixing roller (not shown) and a pressurizing roller (not shown) and, after that, discharged outside and a series of the image forming operation is completed. A transfer residual toner remained on the photosensitive drum 1 after the above described transfer is removed and collected by a cleaning blade 6.

By the way, in the above described image forming time, the transfer material P is sometimes stopped from being conveyed in front of the transfer nip portion due to a paper jam (a transfer material jam) and a sheet feeding failure. In this case, the toner image formed on the photosensitive drum 1 adheres on the surface of the transfer roller 5 instead of being transferred on the transfer material P. The toner adhered on the surface of the transfer roller 5 in this way adheres on a rear surface of the transfer material P which is conveyed to the transfer nip portion in the image forming time subsequent to the canceling of the above described paper jam and sheet feeding failure, and stains it.

Thus, in the present embodiment, in order to prevent such a situation from occurring, a cleaning mode for cleaning the surface of the transfer roller 5 at a non-image forming time including a non-transferring time for not transferring the toner image on the transfer material P was provided as follows.

Figure 6:
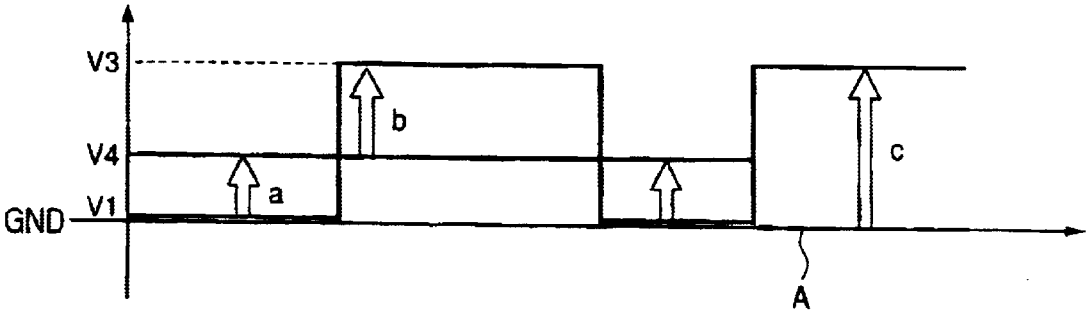
FIG. 6 is a view showing each potential of a photosensitive drum, a developing sleeve and a transfer roller.

In the cleaning of the surface of the transfer roller 5 in the present embodiment, either a positive polarity direct-current voltage from the transfer power source 9 extremely lower than at the normal transfer operation time is outputted to the metal core 5*a* of the transfer roller 5 or the output from the transfer power source 9 is turned off (A of FIG. 6). That is, in order to lower the output of the transfer power source 9, it is sufficient to lower the gain of the amplifier 44 as shown in FIG. 5, and in order to turn off the output of the transfer power source 9, it is sufficient to stop the oscillating of the pulse generator 43.

At this cleaning operation time, the surface of the photosensitive member layer 1*b* of the photosensitive drum 1 is charged by the charging roller 2 which is applied with the alternating voltage from the charging power source 7, and the positive polarity direct-current voltage is applied to the drum base 1*a* of the photosensitive drum 1 from the reference power source 20, and the laser light from the exposing apparatus 3 is irradiated at the surface (the image forming area) of the photosensitive drum 1, so that the surface potential V3 of the photosensitive drum 1 is made about 400 V.

Note that, on this occasion, either the output of the alternating current component from the developing power source 8 is turned off or the amplitude of the alternating current component is made smaller so that the toner t is not allowed to fly. That is, in order to turn off the output of the alternating current component from the developing power source 8, it is sufficient to stop the oscillating of the pulse generator 36*a* as shown in FIG. 4, and in order to lower the output of the alternating current component of the developing power source 8, it is sufficient to lower the gain of the amplifier 37*a*.

Accordingly, at this cleaning operation time, since a potential difference C of (V3−GND) is produced between the photosensitive drum 1 and the transfer roller 5, by this electrostatic force, the toner adhered on the surface of the transfer roller 5 is transferred on the photosensitive drum 1. The toner transferred on the photosensitive drum 1 is removed and collected by the cleaning blade 6.

In this way, since the transfer power source 9 of the present embodiment can omit a circuit for applying a reverse polarity voltage required conventionally at the clearing time of the transfer roller 5, the circuit configuration of the transfer power source 9 can be simplified.

Second Embodiment

Figure 7:
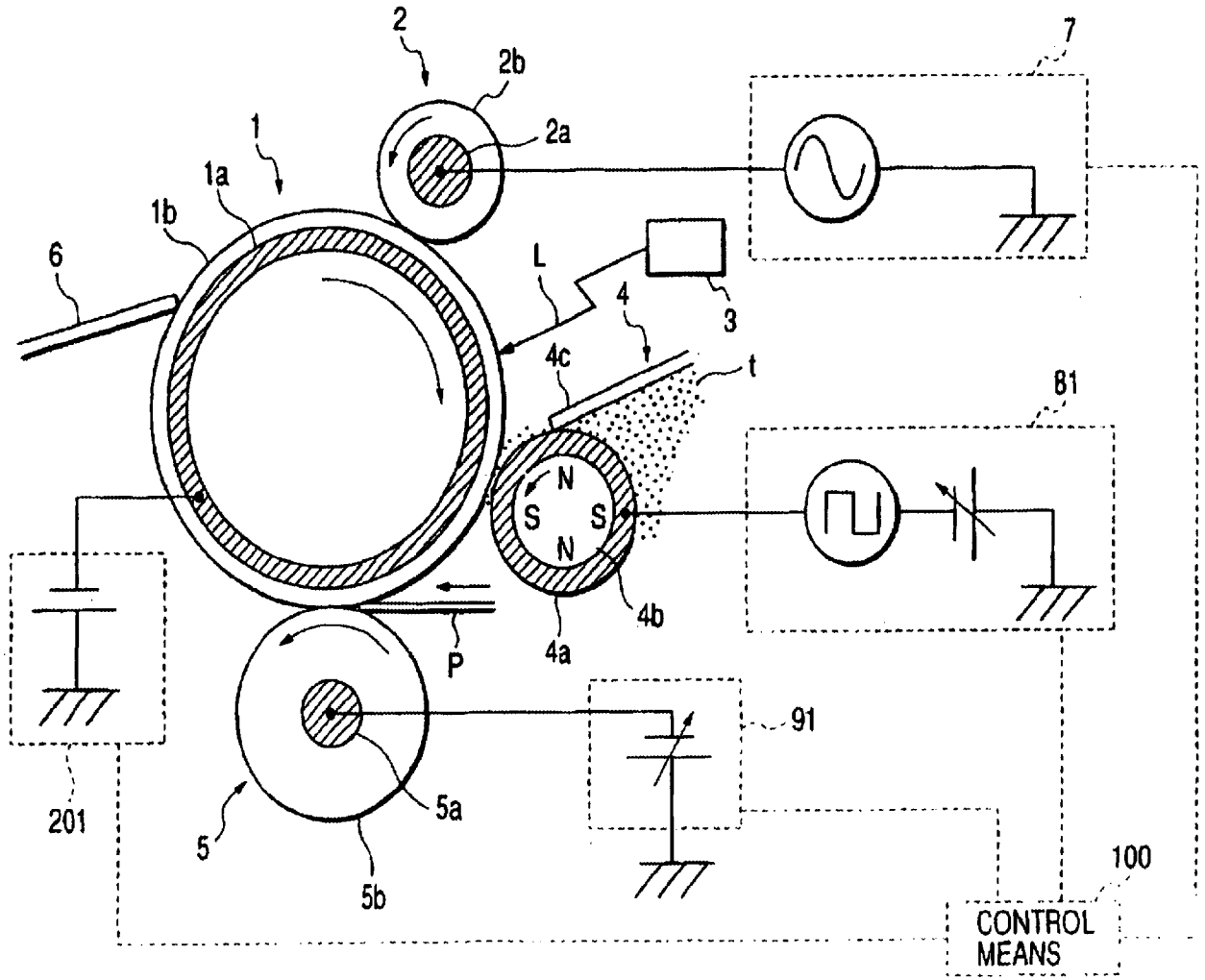
FIG. 7 is a view showing the image forming apparatus which is another embodiment of the present invention.

FIG. 7 is a schematic block diagram showing an image forming apparatus according to a second embodiment of the present invention. Note that the same reference numerals are attached to the same members having the same functions as those of the image forming apparatus of the first embodiment as shown in FIG. 1, and the repetitive description thereof will be omitted. While the image forming apparatus of the first embodiment is configured to carry out development with a toner charged with the negative polarity, the present embodiment is an image forming apparatus configured to carry out development with a toner charged with the positive polarity. The present embodiment also comprises the photosensitive drum 1, the charging roller 2, the exposing apparatus 3, the developing apparatus 4, the transfer roller 5 and the cleaning blase 6 similar to the first embodiment. There is an exception, however, which is that the photosensitive drum 1 of the present embodiment is charged with the negative polarity as described later and therefore the photosensitive member layer 1*b* is constituted accordingly.

The image forming apparatus of the present embodiment has the drum base 1*a* of the photosensitive drum 1 electrically connected to a reference power source 201. The circuit configurations of a developing power source 81, a transfer power source 91 in the present embodiment are constituted as described below. Note that the configuration of a charging power source 7 is similar to that of the first embodiment and the description thereof will be omitted in the present embodiment.

Figure 8:
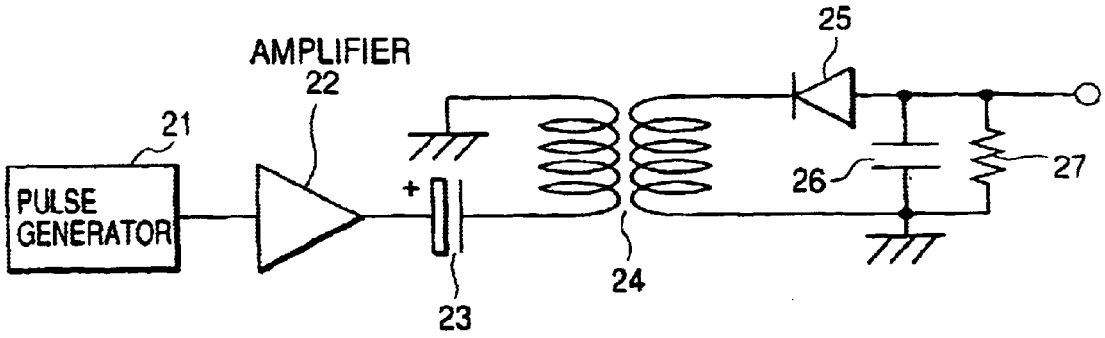
FIG. 8 is a circuit diagram showing the reference power source.

A reference power source 201 of the present embodiment has, as shown in FIG. 8, the same constitution as that of the first embodiment except that the polarity of the diode 25 for rectifying the output of the transformer 24 is reverse to the case of the first embodiment, and by allowing the pulse generator 21 to oscillate, a negative polarity direct-current voltage can be outputted to the drum base 1*a* of the photosensitive drum 1 through the resistor 27.

Figure 9:
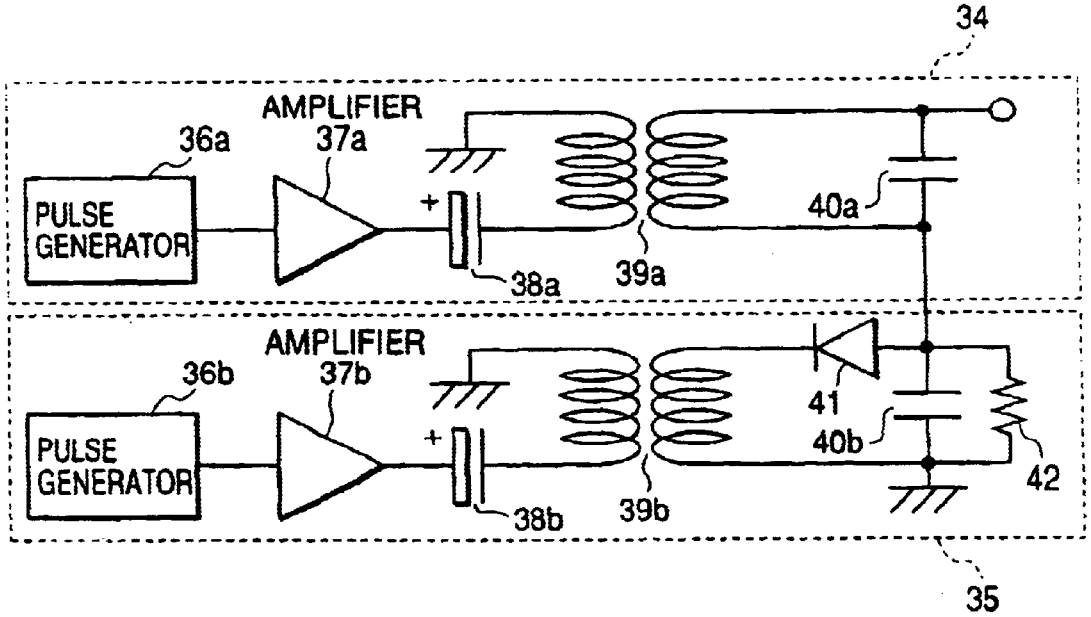
FIG. 9 is a circuit diagram showing the developing power source.

The developing power source 81 of the present embodiment has, as shown in FIG. 9, the same constitution as that of the first embodiment except that the polarity of the diode 41 for rectifying the output from the transformer 39*b* of the direct-current voltage output portion 35 is in reverse to the case of the first embodiment, and by allowing the pulse generator 36*b* to oscillate, a negative polarity direct-current voltage is outputted from the direct-current voltage output portion 35, so that the voltage in which the alternating voltage is superposed on the negative polarity direct-current voltage is outputted from the developing power source 81.

Figure 10:
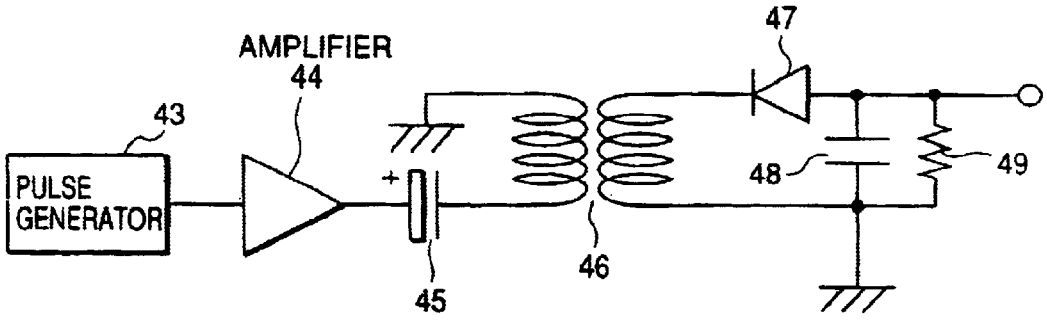
FIG. 10 is a circuit diagram showing the transfer power source.

The transfer power source 91 of the present embodiment has, as shown in FIG. 10, the same constitution as that of the first embodiment except that the polarity of the diode 47 for rectifying the output of the transformer 46 is in reverse to the case of the first embodiment, and by allowing the pulse generator 43 to oscillate, a negative polarity direct-current voltage can be outputted to the metal core 5*a* of the transfer roller 5 through the resistor 49.

Next, the image forming operation by the image forming apparatus in the present embodiment will be described. In the present embodiment, the polarity of the reference power source 201, the polarity of the developing power source 81 and the polarity of the transfer power source 91 are reversed in the polarity for the case of the first embodiment. In this way, the potential of the portions subjected to the image-exposure-L and not subjected to the image-exposure-L on the surface of the photosensitive drum 1 is reversed in the polarity for the first embodiment.

At the image formation forming time, the photosensitive drum 1 is rotationally driven by a drive apparatus (not shown) in the arrow direction (clockwise) at a predetermined circumferential speed. On this occasion, the charging roller 2 is applied with high voltage of the sine wave outputted from the charging power source 7 as shown in FIG. 3.

By the charging roller 2 applied with high voltage of this sine wave, the surface of the photosensitive member layer 1*b* of the photosensitive drum 1 is evenly charged with a voltage of the center of the amplitude of the above described sine wave to be applied, that is, a predetermined voltage (−V1: about −10 V) which is approximately equal to the ground (GND). To the drum base 1*a* of the photosensitive drum 1, a predetermined direct-current voltage (−V2: about −700 V) to be outputted from the reference power source 201 as shown in FIG. 8 is applied.

Accordingly, on both surfaces of the photosensitive member layer 1*b*, a potential difference of (−V2−(−V1)) is produced, and on the charged photosensitive drum 1, the image-exposure-L according to the image signal information from the exposing apparatus 3 is given, so that the potential on the photosensitive drum 1 comes nearer to the potential of the above described reference power source 201 with the potential of the portion subjected to the image-exposure-L reduced lower and the electrostatic latent image according to the image signal to be inputted is formed. On this occasion, the surface potential of the photosensitive drum 1 becomes a potential (−V3: about −600 V) which is about −100 V lower than the output voltage (−V2: about −700 V) of the reference power source 201.

By the developing voltage to be outputted to the developing sleeve 4*a* of the developing apparatus 4 from the developing power source 81 as shown in FIG. 9, the electrostatic latent image formed on the photosensitive drum 1 is developed. The developing operation in the present embodiment will be described below with reference to FIG. 11.

The surface potential of the portion not subjected to the image-exposure-L by the laser light from the exposing apparatus 3 of the photosensitive drum 1 is a voltage (−V1) which is approximately equal to the ground (GND). The toner t in the interior of the developing apparatus 4 is charged with the positive polarity in the present embodiment, and the developing sleeve 4*a* is applied with the negative polarity voltage (−V4) as the direct current component from the developing power source 81.

Accordingly, at a developing position in which the photosensitive drum 1 opposes to the developing sleeve 4*a*, a force a is exerted on the toner t to pull it to the developing sleeve 4*a* from the photosensitive drum 1 in the portion not subjected to the-image-exposure-L of the photosensitive drum 1.

The portion subjected to the image-exposure-L of the photosensitive drum 1 is charged with a potential (−V3: about −600 V) which is about −100 V lower than the output voltage (−V2: about −700 V) of the reference power source 201 as described above.

Therefore, in the portion subjected to the image-exposure-L of the surface of the photosensitive drum 1, a force b is exerted on the toner t to pull it to the photosensitive drum 1 from the developing roller 4*a*. That is, the toner t is adhered only on the portion subjected to the image-exposure-L of the surface of the photosensitive drum 1 and the toner t is not adhered on the portion not subjected to the image-exposure-L of the surface of the photosensitive drum 1, so that a desired toner image is developed (visualized) on the surface of the photosensitive drum 1. Note that the developing sleeve 4*a* is also applied with an alternating voltage from the alternating voltage output portion 34 of the developing power source 81. This is a voltage to be applied for allowing the toner t coated on the surface of the developing sleeve 4*a* to fly.

When the toner image on the photosensitive drum 1 reaches the transfer nip portion between the photosensitive drum 1 and the transfer roller 5, in time for this timing, the transfer material P as the recording material such as paper in the interior of a cassette (not shown) is conveyed to the transfer nip portion by a sheet feeding roller (not shown), and by the transfer roller 5 applied with a predetermined transfer bias of (the negative polarity) the polarity reverse to the above described toner t, the toner image on the photosensitive drum 1 is transferred on the transfer material P conveyed to the transfer nip portion by an electrostatic force generated between the photosensitive drum 1 and the transfer roller 5.

The transfer material P, on which the toner image is transferred, is conveyed to a fixing apparatus (not shown), and the toner image is heated, pressurized and thermally fixed on the transfer material P by a fixing nip between a fixing roller (not shown) and a pressurizing roller (not shown) and, after that, discharged outside and a series of the image forming operation is completed. A transfer residual toner remained on the photosensitive drum 1 after the above described transfer is removed and collected by the cleaning blade 6.

By the way, in the above described image forming time, the transfer material P is sometimes stopped from being conveyed in front of the transfer nip portion due to a paper jam (a transfer material jam) and a sheet feeding failure. In this case, the toner image formed on the photosensitive drum 1 adheres on the surface of the transfer roller 5 instead of being transferred on the transfer material P. The toner adhered on the surface of the transfer roller 5 in this way adheres on a rear surface of the transfer material P which is conveyed to the transfer nip portion in the image forming time subsequent to the canceling of the above described paper jam and sheet feeding failure, and stains it.

Thus, in the present embodiment, in order to prevent such a situation from occurring, a cleaning of the surface of the transfer roller 5 in a non-image-forming time including a non-transferring time for not transferring the toner image on the transfer material P was performed as follows.

Figure 11:
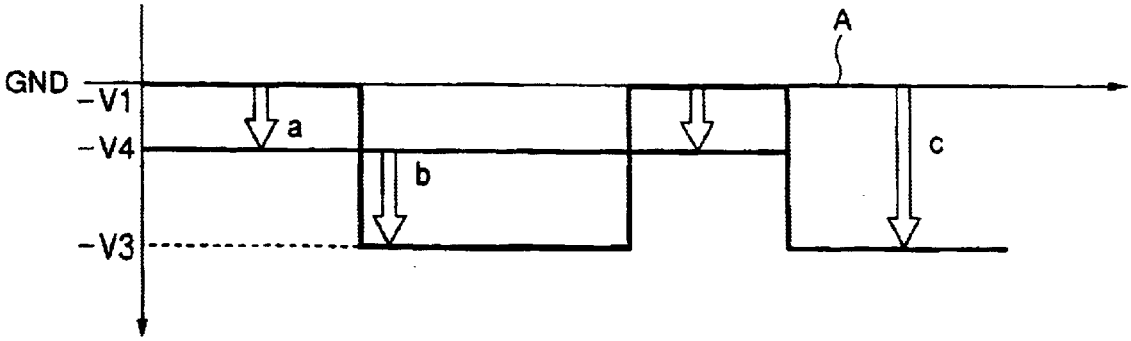
FIG. 11 is a view showing each potential of the photosensitive drum, the developing sleeve and the transfer roller.

At the above described cleaning time of the surface of the transfer roller 5 in the present embodiment, either a negative polarity direct-current voltage from the transfer power source 91 extremely lower than at the normal transfer operation time is outputted to the metal core 5*a* of the transfer roller 5 or the output from the transfer power source 91 is turned off (A of FIG. 11). That is, in order to lower the output of the transfer power source 91, it is sufficient to lower the gain of the amplifier 44 as shown in FIG. 10, and in order to turn off the output of the transfer power source 91, It is sufficient to stop the oscillating of the pulse generator 43.

At this cleaning operation time, the surface of the photosensitive member layer 1*b* of the photosensitive drum 1 is charged by the charging roller 2 which is applied with the alternating voltage from the charging power source 7, and the negative polarity direct-current voltage is applied to the drum base 1*a* of the photosensitive drum 1 from the reference power source 201, and the laser light from the exposing apparatus 3 is irradiated at the surface (the image forming area) of the photosensitive drum 1, so that the surface potential (−V3) of the photosensitive drum 1 is made about −400 V. Note that, on this occasion, either the output of the alternating current component from the developing power source 81 is turned off or the amplitude of the alternating current component is made smaller so that the toner t is not allowed to fly.

Accordingly, at this cleaning operation time, since a potential difference c of (−V3−GND) is produced between the photosensitive drum 1 and the transfer roller 5, by this electrostatic force, the toner adhered on the surface of the transfer roller 5 is transferred on the photosensitive drum 1. The toner transferred on the photosensitive drum 1 is removed and collected by the cleaning blade 6.

In this way, in the present embodiment also, since the transfer power source 91 which applies the transfer voltage to the transfer roller 5 can omit a circuit for applying a reverse polarity voltage required conventionally at the cleaning time of the transfer roller 5, the circuit configuration of the transfer power source 91 can be simplified.

Third Embodiment

Figure 12:
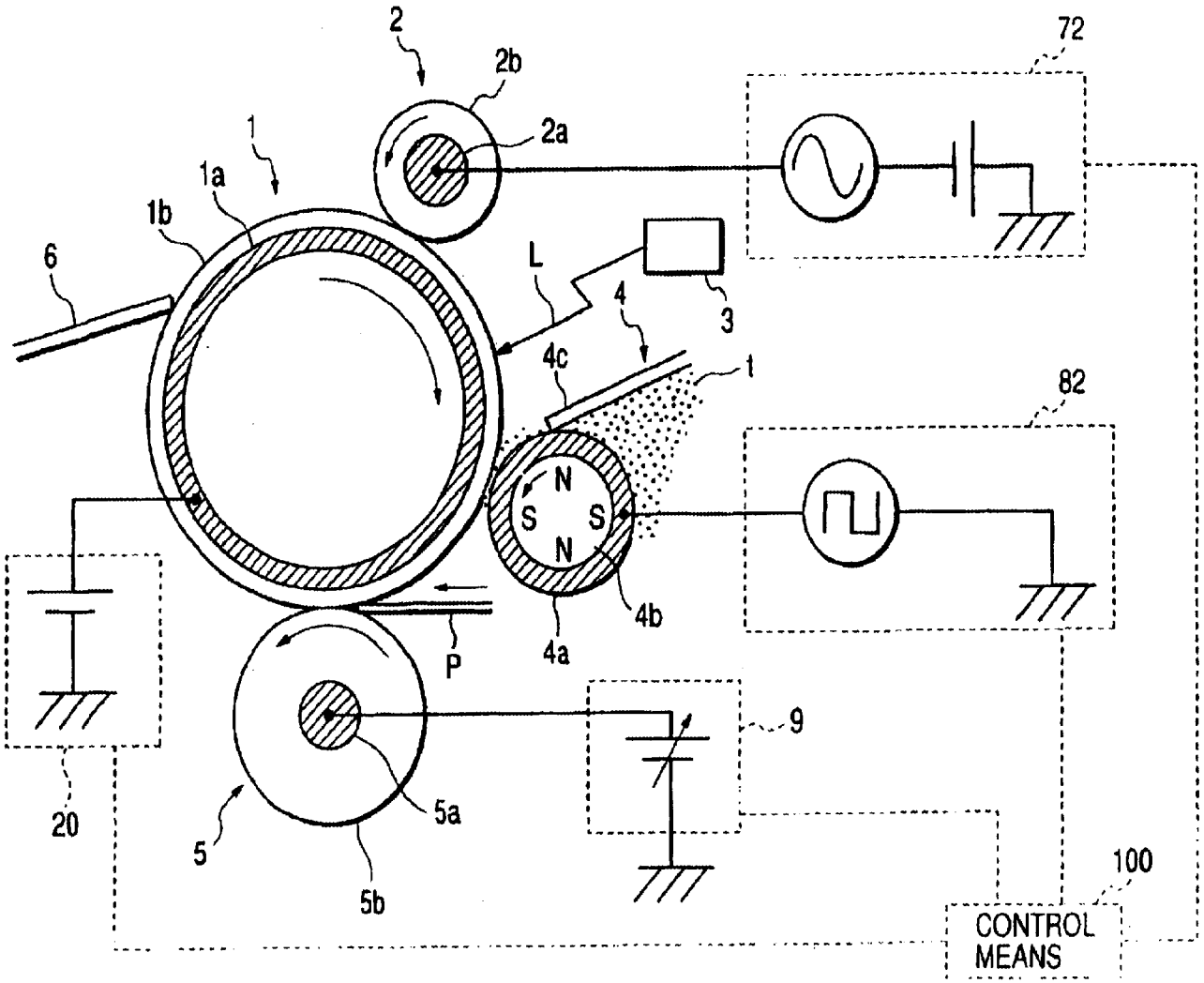
FIG. 12 is a view showing the image forming apparatus which is another embodiment of the present invention.

FIG. 12 is a schematic block diagram showing an image forming apparatus according to a third embodiment of the present invention. Note that the same reference numerals are attached to the members having the same functions as those of the image forming apparatuses of the first and the second embodiments as shown in FIG. 1 and the repetitive description thereof will be omitted. The present embodiment comprises the photosensitive drum 1, the charging roller 2, the exposing apparatus 3, the developing apparatus 4, the transfer roller 5 and the cleaning blade 6 similar to the first embodiment.

The circuit configurations of a charging power source 72, a developing power source 82 in the present embodiment are constituted as described below. Note that the configurations of the reference power source 20 and the transfer power source 9 electrically connected to the drum base 1*a* of the photosensitive drum 1 are the same as those of the first embodiment and the description thereof will be omitted in the present embodiment.

Figure 13:
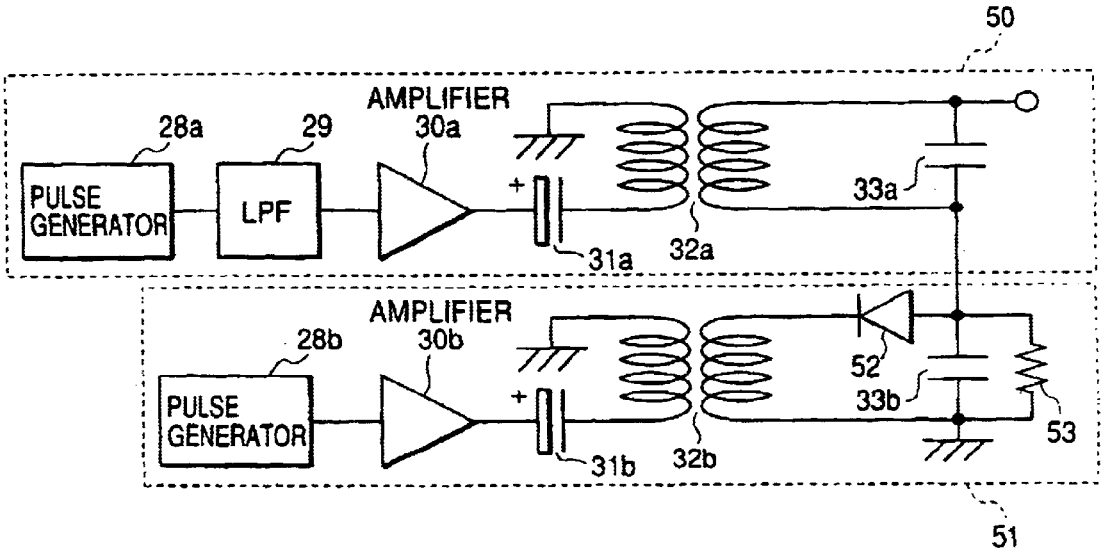
FIG. 13 is a circuit diagram showing the charging power source.

The charging power source 72 of the present embodiment comprises, as shown in FIG. 13, an alternating current output portion 50 for outputting an alternating voltage and a direct current output portion 51 for outputting a direct-current voltage.

The alternating current output portion 50 comprises a pulse generator 28*a* for generating a pulse, a low pass filter (LPF) 29 for shutting off a high frequency component of the pulse outputted from the pulse generator 28*a* and for bringing a square wave near to a sine wave, an amplifier 30*a* for amplifying the sine wave outputted from the low pass filter 29, a block condenser 31*a* for preventing a direct current component of the output of the amplifier 30*a*, a transformer 32*a* for converting the voltage amplitude of an alternating current component of the output of the amplifier 30*a* to a predetermined value of high voltage and a condenser 33*a*.

On the other hand, the direct-current voltage output portion 51 comprises a pulse generator 28*b* for generating a pulse, an amplifier 30*b* for amplifying the pulse outputted from the pulse generator 28*b*, a block condenser 31*b* for preventing an direct current component of the output of the amplifier 30*b*, a transformer 32*b* for converting the voltage amplitude of an alternating current component of the output of the amplifier 30*b* to a predetermined value of high voltage, a diode 52 for rectifying the output of the transformer 31*b* and a condenser 33*b*, a resistor 53.

From the alternating voltage output portion 50 constituted circuit-wise in this way, an alternating voltage is outputted, and from the direct-current voltage output portion 51, a negative polarity direct-current voltage is outputted, so that, from the charging power source 72, an voltage in which the alternating voltage is superposed on the negative polarity direct-current voltage is outputted. By stopping the oscillating of the pulse generator 28*b* of the direct-current voltage output portion 51, an alternating voltage alone is outputted from the charging power source 72.

Figure 14:
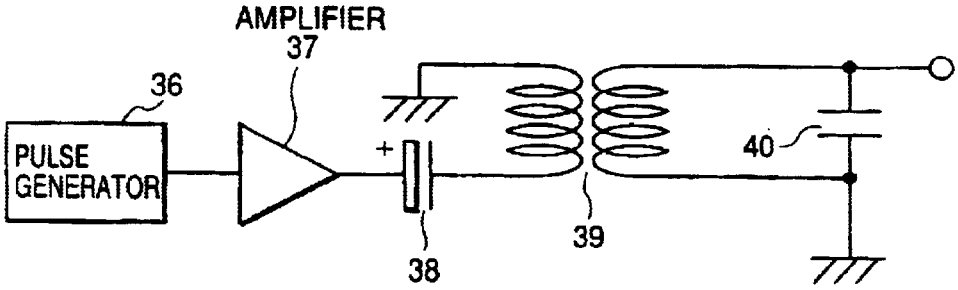
FIG. 14 is a circuit diagram showing the developing power source.

The developing power source 82 of the present embodiment comprises, as shown in FIG. 14, a pulse generator 36 for generating a pulse, an amplifier 37 for amplifying the pulse outputted from the pulse generator 36, a block condenser 38 for preventing an direct current component of the output of the amplifier 37, a transformer 39 for converting the voltage amplitude of an alternating current component of the output of the amplifier 37 to a predetermined value of high voltage and a condenser 40.

By the developing power source 82 constituted circuitwise in this way, the pulse generator 36 is allowed to oscillate, so that a sine wave alternating voltage can be outputted to the metal core 2*a* of the charging roller 2 through the condenser 40.

Next, the image forming operation by the image forming apparatus in the present embodiment will be described.

At the image formation forming time, the photosensitive drum 1 is rotationally driven by a drive apparatus (not shown) in the arrow direction at a predetermined circumferential speed. On this occasion, the charging roller 2 is applied with a voltage in which the alternating voltage is superposed on the negative direct-current voltage outputted from the charging power source 72 as shown in FIG. 13. In this way, the drum base 1*a* of the photosensitive drum 1 is evenly charged with a voltage (−V1: about −200 V) which is approximately equal to the negative polarity direct-current voltage outputted from the charging power source 72. Further, the drum base 1*a* of the photosensitive drum 1 is applied with a predetermined positive polarity direct-current voltage (about 500 V in the present embodiment) V2 outputted from reference power source 20 as shown in FIG. 2.

Accordingly, on both surfaces of the photosensitive member layer 1*b,* a potential difference of −(V1+V2) is produced, and on the charged photosensitive drum 1, the image-exposure-L according to the image information from the exposing apparatus 3 is given, so that the potential on the photosensitive drum 1 comes nearer to the potential of the above described reference power source 20 with the potential of the portion subjected to the image-exposure-L reduced lower and the electrostatic latent image according to the image signal to be inputted is formed. On this occasion, the surface potential of the photosensitive drum 1 becomes a potential (about 400 V) V3 which is about 100 V lower than the output voltage V2 (500 V) of the reference power source 20.

By the developing voltage outputted from the developing power source 82 as shown in FIG. 14 to the developing sleeve 4*a* of the developing apparatus 4, the electrostatic latent image formed on the photosensitive drum 1 is developed. The developing operation of the present embodiment will be described below with reference to FIG. 15.

Since the surface potential of the portion not subjected to the image-exposure-L by the laser light from the exposing apparatus 3 of the photosensitive drum 1 is a potential (−V1: about −200 V) which is approximately equal to the negative polarity direct-current voltage outputted from the charging power source 72, it is a negative voltage. The toner t in the interior of the developing apparatus 4 is charged with the negative polarity in the present embodiment.

Accordingly, at a developing position in which the photosensitive drum 1 opposes to the developing sleeve 4*a,* a force a is exerted on the toner t to pull it to the developing sleeve 4*a* from the photosensitive drum 1 in the portion not subjected to the image-exposure-L of the photosensitive drum 1.

The portion subjected to the image-exposure-L of the photosensitive drum 1 is charged with a potential (about 400 V) V3 which is about 100 V lower than the output voltage V2 (500 V) of the reference power source 20 as described above.

Therefore, in the portion subjected to the image-exposure-L of the surface of the photosensitive drum 1, a force b is exerted on the toner t to pull it to the photosensitive drum 1 from the developing roller 4*a.* That is, the toner t is adhered only on the portion subjected to the image-exposure-L of the surface of the photosensitive drum 1 and the toner t is not adhered on the portion not subjected to the image-exposure-L of the surface of the photosensitive drum 1, so that a desired toner image is developed (visualized) on the surface of the photosensitive drum 1. Note that the developing sleeve 4*a* is applied with the alternating voltage from the developing power source 82. This is a voltage to be applied for allowing the toner t coated on the surface of the developing sleeve 4*a* to fly.

When the toner image on the photosensitive drum 1 reaches the transfer nip portion between the photosensitive drum 1 and the transfer roller 5, in time for this timing, the transfer material P such as the paper in the interior of a cassette (not shown) is conveyed to the transfer nip portion by a sheet feeding roller (not shown), and by the transfer roller 5 applied with a predetermined transfer bias of the polarity (the positive polarity) reverse to the above described toner t, the toner image on the photosensitive drum 1 is transferred on the transfer material P conveyed to the transfer nip portion by an electrostatic force generated between the photosensitive drum 1 and the transfer roller 5.

The transfer material P, on which the toner image is transferred, is conveyed to a fixing apparatus (not shown), and the toner-image is heated, pressurized and thermally fixed on the transfer material P by a fixing nip between a fixing roller (not shown) and a pressurizing roller (not shown) and, after that, discharged outside and a series of the image forming operation is completed. A transfer residual toner remained on the photosensitive drum 1 after the above described transfer is removed and collected by the cleaning blade 6.

By the way, in the above described image forming time, the transfer material P is sometimes stopped from being conveyed in front of the transfer nip portion due to a paper jam (a transfer material jam) and a sheet feeding failure. In this case, the toner image formed on the photosensitive drum 1 adheres on the surface of the transfer roller 5 instead of being transferred on the transfer material P. The toner adhered on the surface of the transfer roller 5 in this way adheres on a rear surface of the transfer material P which is conveyed to the transfer nip portion in the image forming time subsequent to the canceling of the above described paper jam and sheet feeding failure, and stains it.

Thus, in the present embodiment, in order to prevent such a situation from occurring, a cleaning of the surface of the transfer roller 5 in a non-image forming time including a non-transferring time for not transferring the toner image on the transfer material P was performed as follows.

Figure 15:
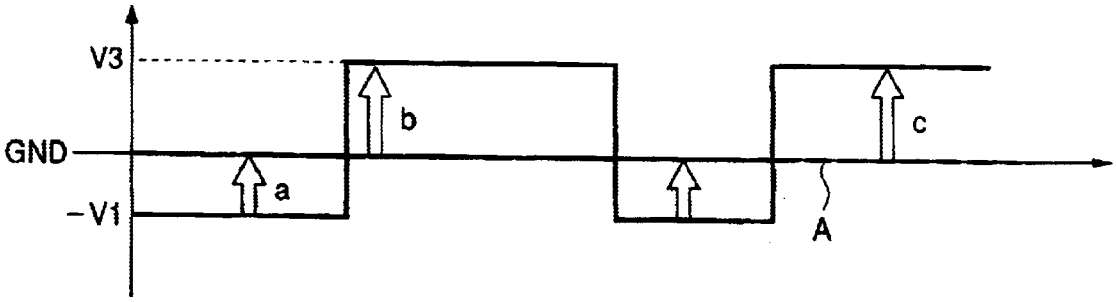
FIG. 15 is a view showing each potential of the photosensitive drum, the developing sleeve and the transfer roller.

At the above described cleaning time of the surface of the transfer roller 5 in the present embodiment, either a positive polarity direct-current voltage from the transfer power source 9 extremely lower than at the normal transfer operation time is outputted to the metal core 5*a* of the transfer roller 5 or the output from the transfer power source 9 is turned off (A of FIG. 15). That is, in order to lower the output of the transfer power source 9, it is sufficient to lower the gain of the amplifier 44 as shown in FIG. 10, and in order to turn off the output of the transfer power source 9, it is sufficient to stop the oscillating of the pulse generator 43.

At this cleaning operation time, the surface of the photosensitive member layer 1*b* of the photosensitive drum 1 is charged by the charging roller 2 which is applied only with the alternating voltage from the charging power source 72, and the positive polarity direct-current voltage is applied to the drum base 1*a* of the photosensitive drum 1 from the reference power source 20, and the laser light from the exposing apparatus 3 is irradiated at the surface (the image forming area) of the photosensitive drum 1, so that the surface potential (V3) of the photosensitive drum 1 is made about 400 V. Note that, on this occasion, either the output of the alternating current component from the developing power source 82 is turned off or the amplitude of the alternating current component is made smaller so that the toner t is not allowed to fly.

Accordingly, at this cleaning time, since a potential difference c of (V3−GND) is produced between the photosensitive drum 1 and the transfer roller 5, by this electrostatic force, the toner adhered on the surface of the transfer roller 5 is transferred on the photosensitive drum 1. The toner transferred on the photosensitive drum 1 is removed and collected by the cleaning blade 6.

In this way, in the present embodiment also, since the transfer power source 9 which applies the transfer voltage to the transfer roller 5 can omit a circuit for applying a reverse polarity voltage required conventionally at the cleaning time of the transfer roller 5, the circuit configuration of the transfer power source 9 can be simplified.

Fourth Embodiment

Figure 16:
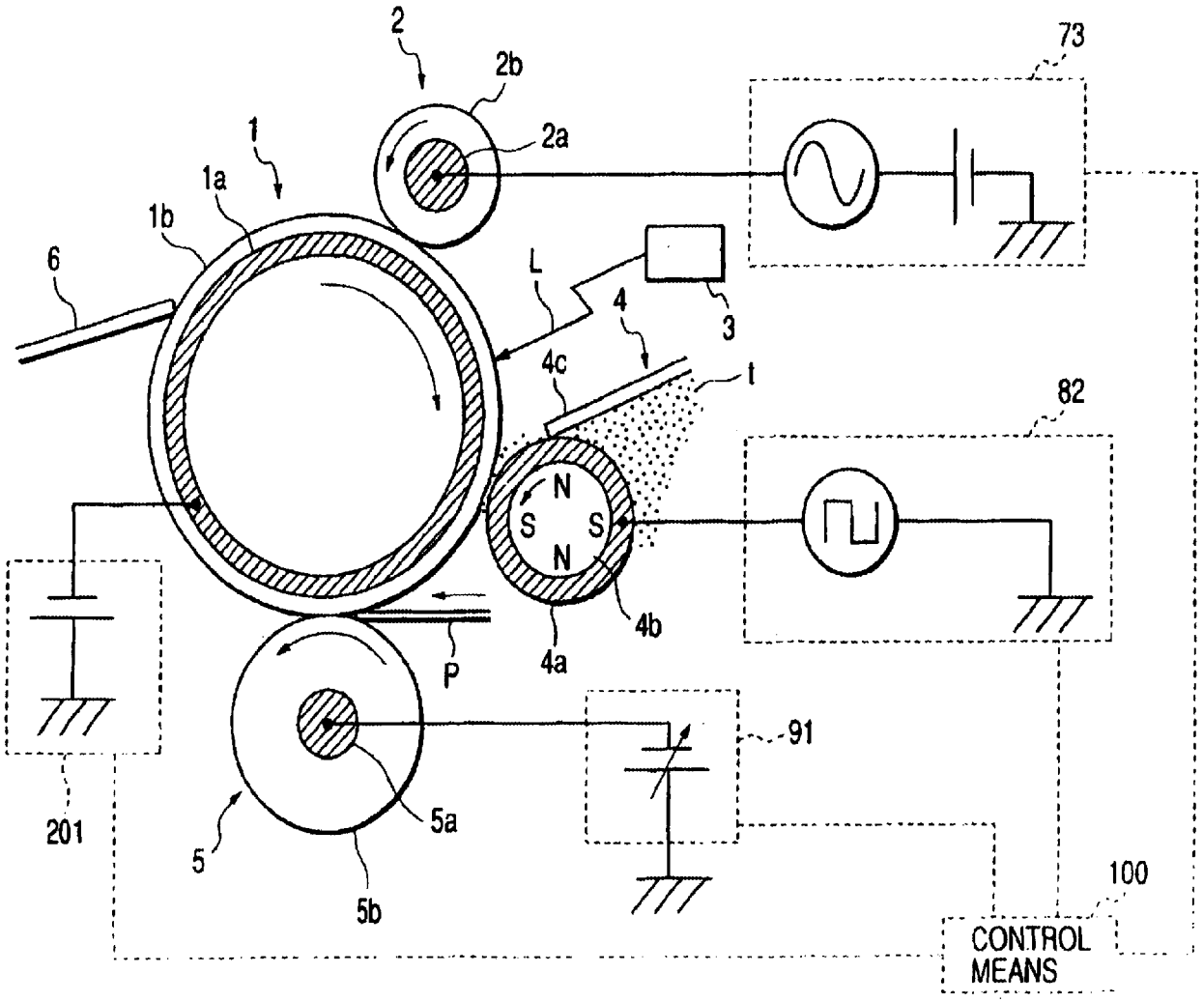
FIG. 16 is a view showing the image forming apparatus which is another embodiment of the present invention.

FIG. 16 is a schematic block diagram showing an image forming apparatus according to a fourth embodiment of the present invention. Note that the same reference numerals are attached to the same members having the same functions as those of the image forming apparatuses of the first, the second and the third embodiments and the repetitive description thereof will be omitted. Although the image forming apparatus of the third embodiment was constituted to develop by the toner charged with the negative polarity, the present embodiment is an image forming apparatus constituted to develop by the toner charged with the positive polarity. The present embodiment also comprises the photosensitive drum 1, the charging roller 2, the exposing apparatus 3, the developing apparatus 4, the transfer roller 5 and the cleaning blade 6 similar to those of the first, the second and the third embodiments.

In the image forming apparatus of the present embodiment, the circuit configuration of a charging power source 73 is constituted as follows. Note that the constitutions of the reference power source 201 and the transfer power source 91 are the same as those of the second embodiment, and the constitution of the developing power source 82 is the same as that of the third embodiment, and the description of these members will be omitted in the present embodiment.

Figure 17:
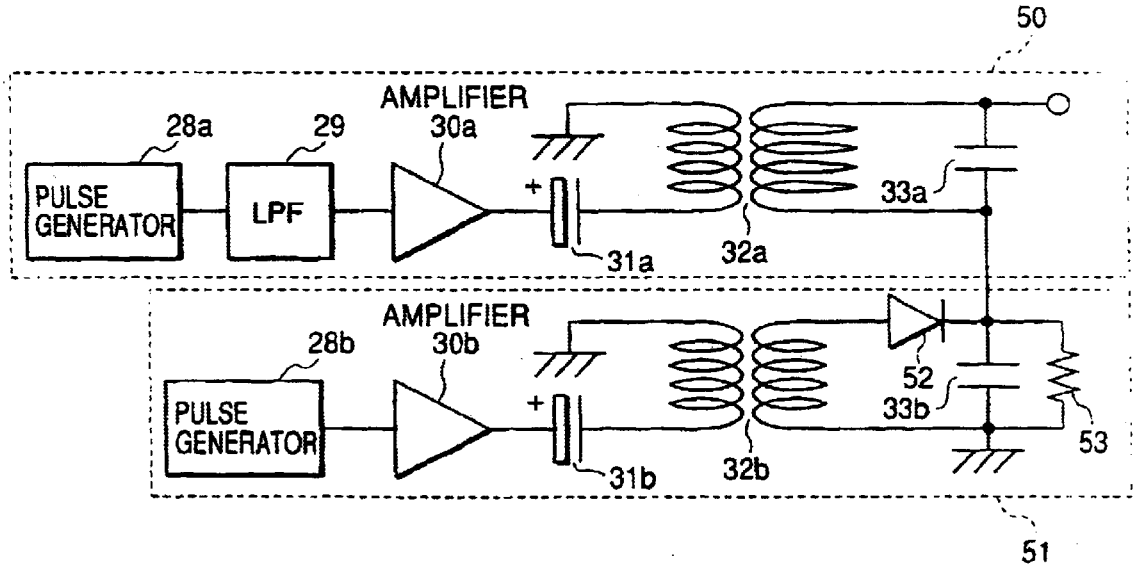
FIG. 17 is a circuit diagram showing the charging power source.

The charging power source 73 of the present embodiment has, as shown in FIG. 17, the same constitution as that of the third embodiment except that the polarity of the diode 52 for rectifying the output of the transformer 32*b* of the direct-current voltage output portion 51 is in reverse to the case of the third embodiment, and by allowing the pulse generator 28*b* to oscillate, a positive polarity direct-current voltage can be outputted from the direct-current voltage output portion 51, so that the voltage in which the alternating voltage is superposed on the positive polarity direct-current voltage is outputted from the charging power source 73.

Next, the image forming operation by the image forming apparatus in the present embodiment will be described. In the present embodiment, the polarity of the reference power source 201, the polarity of the developing power source 82 and the polarity of the transfer power source 91 are reversed in the polarity for the case of the third embodiment. In this way, the potential of the portions subjected to the image-exposure-L and not subjected to the image-exposure-L on the surface of the photosensitive drum 1 is reversed in the polarity for the first embodiment.

In the image formation forming time, the photosensitive drum 1 is rotationally driven by a drive apparatus (not shown) in the arrow direction at a predetermined circumferential speed. On this occasion, the charging roller 2 is applied with a voltage in which a sine wave alternating voltage is superposed on a positive direct-current voltage outputted from the charging power source 73 as shown in FIG. 17. In this way, the drum base 1*a* of the photosensitive drum 1 is evenly charged with a voltage (V1: about 200 V) which is approximately equal to the positive polarity direct-current voltage outputted from the charging power source 73. Further, the drum base 1*a* of the photosensitive drum 1 is applied with a predetermined negative polarity direct-current voltage (−V2: about −500 V) outputted from the reference power source 201 as shown in FIG. 8.

Accordingly, on both surfaces of the photosensitive member layer 1*b*, a potential difference of V1−(−V2) is produced, and, on the charged photosensitive drum 1, the image-exposure-L according to the image information from the exposing apparatus 3 is given, so that the potential on the photosensitive drum 1 comes nearer to the potential of the above described reference power source 20 with the potential of the portion subjected to the image-exposure-L reduced lower and the electrostatic latent image according to the image signal to be inputted is formed. On this occasion, the surface potential of the photosensitive drum 1 becomes a potential (−V3: about −400 V) which is about 100 V lower than the output voltage (−V2; about −500 V) of the reference power source 201.

By the developing voltage outputted from the developing power source 82 to the developing sleeve 4*a* of the developing apparatus 4, the electrostatic latent image formed on the photosensitive drum 1 is developed. The developing operation of the present embodiment will be described below with reference to FIG. 18.

Since the surface potential of the portion not subjected to the image-exposure-L by the laser light from the exposing apparatus 3 of the photosensitive drum 1 is a potential (V1: about 200 V) which is approximately equal to the positive polarity direct-current voltage outputted from the charging power source 73, it is a positive voltage. The toner t in the interior of the developing apparatus 4 is charged with the positive polarity in the present embodiment.

Accordingly, at a developing position in which the photosensitive drum 1 opposes to the developing sleeve 4*a*, a force a is exerted on the toner t to pull it to the developing sleeve 4*a* from the photosensitive drum 1 in the portion not subjected to the image-exposure-L of the photosensitive drum 1.

The portion subjected to the image-exposure-L of the photosensitive drum 1 is charged with a potential (−V3: about −400 V) which is about 100 V lower than the output voltage (−V2: about −500 V) of the reference power source 201 as described above.

Therefore, in the portion subjected to the image-exposure-L of the surface of the photosensitive drum 1, a force b is exerted on the toner t to pull it to the photosensitive drum 1 from the developing roller 4*a*.

That is, the toner t is adhered only on the portion subjected to the image-exposure-L of the surface of the photosensitive drum 1 and the toner t is not adhered on the portion not subjected to the image-exposure-L of the surface of the photosensitive drum 1, so that a desired toner image is developed (visualized) on the surface of the photosensitive drum 1. Note that the developing sleeve 4*a* is applied with the alternating voltage from the developing power source 82. This is a voltage to be applied for allowing the toner t coated on the surface of the developing sleeve 4*a* to fly.

When the toner image on the photosensitive drum 1 reaches the transfer nip portion between the photosensitive drum 1 and the transfer roller 5, in time for this timing, the transfer material P such as the paper in the interior of a cassette (not shown)is conveyed to the transfer nip portion by a sheet feeding roller (not shown), and by the transfer roller 5 applied with a predetermined transfer bias of the polarity (the negative polarity) reverse to the above described toner t, the toner image on the photosensitive drum 1 is transferred on the transfer material P conveyed to the transfer nip portion by an electrostatic force generated between the photosensitive drum 1 and the transfer roller 5.

The transfer material P, on which the toner image is transferred, is conveyed to a fixing apparatus (not shown), and the toner image is heated, pressurized and thermally fixed on the transfer material P by a fixing nip between a fixing roller (not shown) and a pressurizing roller (not shown) and, after that, discharged outside and a series of the image forming operation is completed. A transfer residual toner remained on the photosensitive drum 1 after the above described transfer is removed and collected by the cleaning blade 6.

By the way, in the above described image forming time, the transfer material P is sometimes stopped from being conveyed in front of the transfer nip portion due to a paper jam (a transfer material jam) and a sheet feeding failure. In this case, the toner image formed on the photosensitive drum 1 adheres on the surface of the transfer roller 5 instead of being transferred on the transfer material P. The toner adhered on the surface of the transfer roller 5 in this way adheres on a rear surface of the transfer material P which is conveyed to the transfer nip portion in the image forming time subsequent to the canceling of the above described paper jam and sheet feeding failure, and stains it.

Thus, in the present embodiment, in order to prevent such a situation from occurring, a cleaning of the surface of the transfer roller 5 in a non-image forming time including a non-transferring time for not transferring the toner image on the transfer material P was performed as follows.

Figure 18:
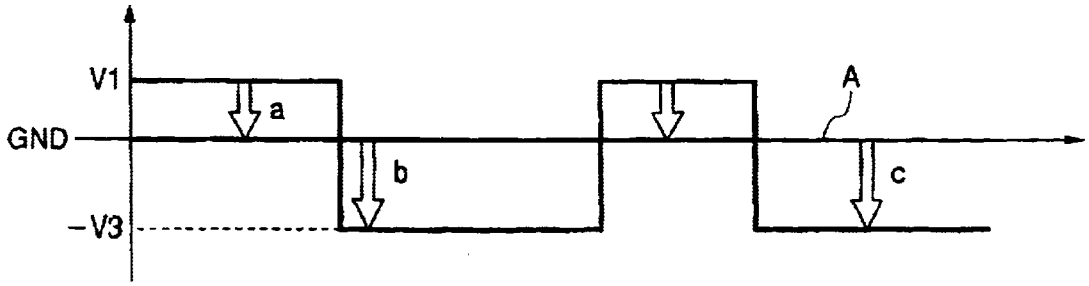
FIG. 18 is a view showing each potential of the photosensitive drum, the developing sleeve and the transfer roller.
Figure 19:
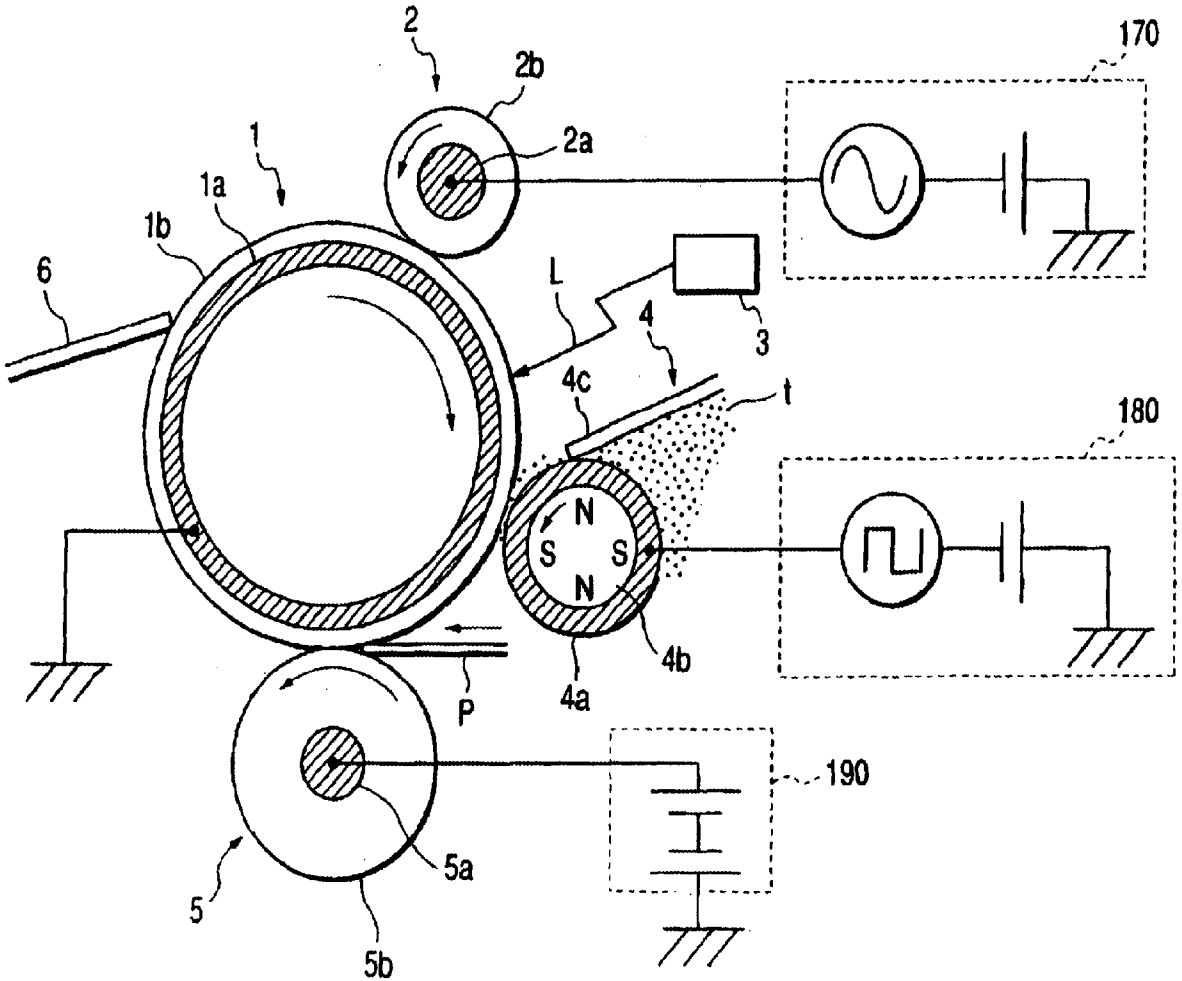
FIG. 19 is a view showing the conventional image forming apparatus.

In the above described cleaning time of the surface of the transfer roller 5 in the present embodiment, either a negative polarity direct-current voltage from the transfer power source 91 extremely lower than at the normal transfer operation time is outputted to the metal core 5*a* of the transfer roller 5 or the output from the transfer power source 91 is turned off (A of FIG. 18). That is, in order to lower the output of the transfer power source 91, it is sufficient to lower the gain of the amplifier 44 as shown in FIG. 10, and in order to turn off the output of the transfer power source 91, it is sufficient to stop the oscillating of the pulse generator 43.

At this cleaning operation time, the surface of the photosensitive member layer 1*b* of the photosensitive drum 1 is charged by the charging roller 2 which is applied only with the alternating voltage from the charging power source 73, and the negative polarity direct-current voltage is applied to the drum base 1*a* of the photosensitive drum 1 from the reference power source 201, and the laser light from the exposing apparatus 3 is irradiated at the surface (the image forming area) of the photosensitive drum 1, so that the surface potential (−V3) of the photosensitive drum 1 is made about −400 V. Note that, on this occasion, either the output of the alternating current component from the developing power source 82 is turned off or the amplitude of the alternating current component is made smaller so that the toner t is not allowed to fly.

Accordingly, at this cleaning time, since a potential difference c of (−V3−GND)is produced between the photosensitive drum 1 and the transfer roller 5, by this electrostatic force, the toner adhered on the surface of the transfer roller 5 is transferred on the photosensitive drum 1. The toner transferred on the photosensitive drum 1 is removed and collected by the cleaning blade 6.

In this way, in the present embodiment also, since the transfer power source 91 which applies the transfer voltage to the transfer roller 5 can omit a circuit for applying a reverse polarity voltage required conventionally at the cleaning time of the transfer roller 5, the circuit configuration of the transfer power source 91 can be simplified.

As described above, according to the present invention, even when the power source means for applying the transfer voltage to the transfer means is not provided with a circuit for generating the direct-current voltage of the polarity reverse to a transferring time for performing a cleaning of the toner adhered on the transfer means, a cleaning of the toner adhered on the transfer means can be performed and the circuit configuration of the power source means for applying the transfer voltage can be simplified.

While, in the above described embodiments, the transfer material has been described as a recording material such as a paper, the transfer material can be taken as an intermediate transfer material (a belt or a drum) which once bears the image thereon before the image on the photosensitive drum is transferred to the paper, and the present invention can also be well applied to cleaning of this intermediate transfer member.

While the preferred embodiments of the present invention have been described above, the invention shall not be limited to those specific embodiments and various modifications can be effected within the scope and the spirit of the present invention.

What is claimed is:

1. An image forming apparatus, comprising:

an image bearing member having a photosensitive portion on a conductive portion;

charging means for charging said image bearing member;

exposing means for exposing said image bearing member being charged to form an electrostatic latent image;

developing the electrostatic latent image by a toner;

transfer means for transferring a toner image on said image bearing member to a transfer material;

image bearing member voltage applying means being electrically connected to the conductive portion of said image bearing member for applying a voltage having a polarity reverse to that of the toner to the conductive portion of said image bearing member;

charging voltage applying means for applying a voltage to said charging means;

developing voltage applying means for applying a voltage to said developing means; and transfer voltage applying means for applying only a voltage having a polarity reverse to that of the toner to said transfer means, wherein said apparatus has a cleaning mode in which, when an image forming is not effected, the voltage is applied to said image bearing member by said image bearing member voltage applying means and the voltage applied to said transfer means from said transfer voltage applying means is turned off or made lower than the voltage applied when the image forming is effected.

2. An image forming apparatus according to claim 1, wherein the voltage applied by said transfer voltage applying means is a direct-current voltage.

3. An image forming apparatus according to claim 1, wherein the voltage applied by said transfer voltage applying means is a direct-current voltage.

4. An image forming apparatus according to claim 1, wherein, when the image forming is effected, the voltage applied by said charging voltage applying means is an alternating voltage, and the voltage applied by said developing voltage applying means is a voltage in which an alternating voltage is superposed on a direct-current voltage that has a polarity reverse to that of the toner and is lower than the voltage applied by said bearing member voltage applying means.

5. An image forming apparatus according to claim 1, wherein, when the image forming is effected, the voltage applied by said charging voltage applying means is a voltage in which an alternating voltage is superposed on a direct-current voltage having the same polarity as that of the toner, and the voltage applied by said developing voltage applying means is an alternating voltage.

6. An image forming apparatus according to claim 1, wherein, in the cleaning mode, said image bearing member is charged by said charging means applied with a voltage by said charging voltage applying means, and said image bearing means is exposed by said exposing means, and the voltage applied to said developing means from said developing voltage applying means is made lower than the voltage applied when the image forming is effected.

7. An image forming apparatus according to claim 6, wherein, when the image forming is effected, the voltage applied by said charging voltage applying means is an alternating voltage, and the voltage applied by said developing voltage applying means is a voltage in which an alternating voltage is superposed on a direct-current voltage, and, in the cleaning mode, the voltage applied to said developing means from said developing voltage applying means is a direct-current voltage only or a voltage in which a direct-current voltage is superposed on an alternating voltage lower than that when the image forming is effected.

8. An image forming apparatus according to claim 6, wherein, when the image forming is effected, the voltage applied by said charging voltage applying means is a voltage in which an alternating voltage is superposed on a direct-current voltage, and the voltage applied by said developing voltage applying means is an alternating voltage, and, in the cleaning mode, the voltage applied to said charging means from said charging voltage applying means is an alternating voltage only, and the voltage applied to said developing means from said developing voltage applying means is turned off or an alternating voltage lower than that when the image forming is effected.

* * * * *

UNITED STATES PATENT AND TRADEMARK OFFICE

CERTIFICATE OF CORRECTION

PATENT NO. : 6,628,905 B2
DATED : September 30, 2003
INVENTOR(S) : Kenjiro Hori et al.

It is certified that error appears in the above-identified patent and that said Letters Patent is hereby corrected as shown below:

Title page,
Item [57], ABSTRACT,
Lines 3-4, "having a polarity reverse to that" should read -- having the same polarity as that --.

Figure 20:
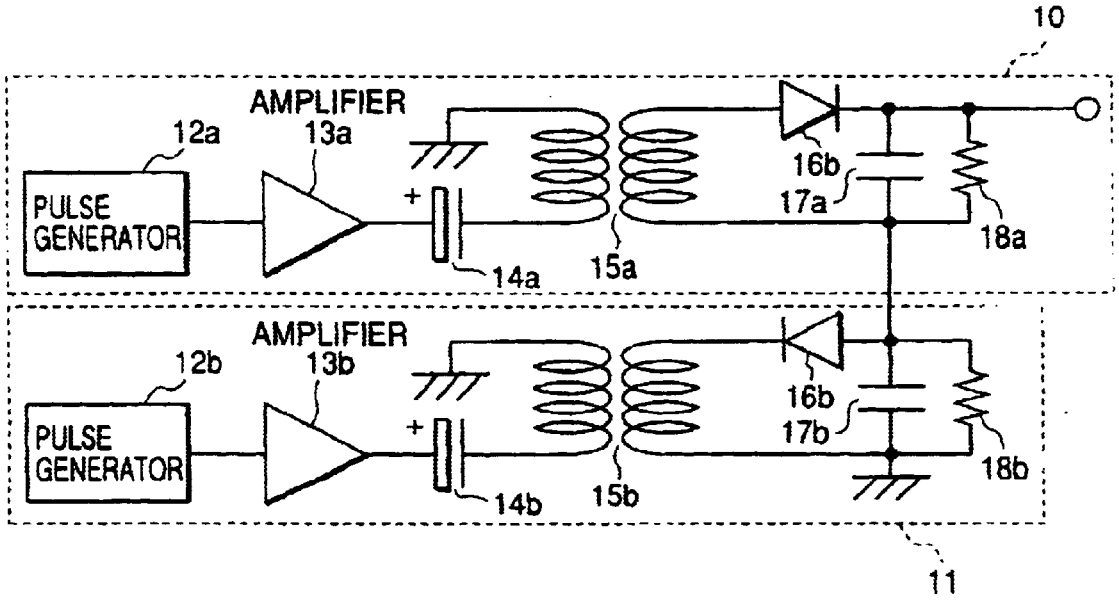
FIG. 20 a circuit diagram showing the conventional transfer power source.

Column 5,
Line 46, "FIG. 20" should read -- FIG. 20 is --.

Column 7,
Line 67, "preventing an" should read -- preventing a --.

Column 8,
Line 10, "an voltage" should read -- a voltage --.
Line 21, "an direct" should read -- a direct --.

Column 14,
Line 54, "an direct" should read -- a direct --.
Line 64, "an voltage" should read -- a voltage --.

Column 15,
Line 7, "an direct" should read -- a direct --.

Column 20,
Line 52, "developing" should read -- developing means for developing --.

Column 21,
Line 10, "transfer" should read -- image bearing member --.

Signed and Sealed this

Twenty-third Day of March, 2004

JON W. DUDAS
*Acting Director of the United States Patent and Trademark Office*